US012017273B2

(12) United States Patent
Bauer et al.

(10) Patent No.: US 12,017,273 B2
(45) Date of Patent: Jun. 25, 2024

(54) SUBMERGED NOZZLE WITH ROTATABLE INSERT

(71) Applicant: REFRACTORY INTELLECTUAL PROPERTY GMBH & CO. KG, Vienna (AT)

(72) Inventors: Christoph Bauer, Graz (AT); Wolfgang Fellner, Leoben (AT); Norbert Freiberger, Graz (AT); Raghunath Prasad Rana, Leoben (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 63 days.

(21) Appl. No.: 17/918,847

(22) PCT Filed: Apr. 21, 2021

(86) PCT No.: PCT/EP2021/060258
§ 371 (c)(1),
(2) Date: Oct. 13, 2022

(87) PCT Pub. No.: WO2021/214070
PCT Pub. Date: Oct. 28, 2021

(65) Prior Publication Data

US 2023/0136922 A1 May 4, 2023

(30) Foreign Application Priority Data

Apr. 21, 2020 (EP) ..... 20170500

(51) Int. Cl.
*B22D 41/50* (2006.01)
*B22D 11/103* (2006.01)
(Continued)

(52) U.S. Cl.
CPC ..... *B22D 41/507* (2013.01); *B22D 11/103* (2013.01); *B22D 41/52* (2013.01); *B22D 41/62* (2013.01)

(58) Field of Classification Search
CPC .. B22D 11/0642; B22D 41/50; B22D 41/507; B22D 41/62
See application file for complete search history.

(56) References Cited

U.S. PATENT DOCUMENTS 6,435,385 B1 * 8/2002 Marukawa ..... B22D 41/507 222/606

FOREIGN PATENT DOCUMENTS

CN 108436071 A 8/2018
JP H0474820 A 3/1992
(Continued)

OTHER PUBLICATIONS

"International Search Report and Written Opinion for PCT Patent Application No. PCT/EP2021/060258", dated Dec. 21, 2021, 10 pages.

*Primary Examiner* — Kevin E Yoon
(74) *Attorney, Agent, or Firm* — Calfee, Halter & Griswold LLP

(57) ABSTRACT

Submerged nozzle (1) through which molten steel can be poured from a tundish into a mould, said nozzle comprising: a substantially tubular body (2), extending from a first end (3) to a second end (4); a passageway (5), extending through the tubular body (2) along a longitudinal axis (A) from the first end (3) towards the second end (4); at least one inlet port (6), opening into the passageway (5) at said first end (3); a plurality of outlet ports (8), opening into the passageway (5) in a region (7) adjacent to the second end (4); and at least one rotatable insert (10); whereas the submerged nozzle (1) with the at least one rotatable insert (10) is configured that a molten metal entering the submerged nozzle (1) at the at
(Continued)

least one inlet port (6) flows through the passageway (5) and around the rotatable insert (10) and exits the submerged entry nozzle (1) via the plurality of outlet ports (8), such that a rotation of the rotatable insert (10) is driven by the stream of molten metal.

20 Claims, 3 Drawing Sheets

(51) Int. Cl.
*B22D 41/52* (2006.01)
*B22D 41/62* (2006.01)

(56) References Cited

FOREIGN PATENT DOCUMENTS

| | | | | |
|---|---|---|---|---|
| KR | 2011034467 | A | * | 4/2011 |
| WO | 2015018543 | A1 | | 2/2015 |
| WO | 2021214070 | A2 | | 10/2021 |
| WO | 2021214070 | A3 | | 10/2021 |

* cited by examiner

SUBMERGED NOZZLE WITH ROTATABLE INSERT

The invention relates to a submerged nozzle with a rotatable insert, in particular a submerged entry nozzle (SEN), a monotube (MT), or a submerged entry shroud (SES), through which molten steel can be poured from a tundish into a mould, and to a method for continuous casting of molten steel, using the submerged nozzle.

Submerged nozzles, such as submerged entry nozzles (SEN) a monotubes, or submerged entry shrouds (SES) are known, for example from EP 1 671 721 B1 or EP 3 488 949 A1 or EP 2 382 062 B1. Such nozzles generally comprise a substantially tubular body extending from a first end to a second end, with a passageway (for example a bore), extending through the tubular body along a longitudinal axis from the first to the second end. In its use position in the continuous casting machine, the nozzle is arranged generally vertically, with the central longitudinal axis of the passageway extending vertically and with the first end of the tubular body positioned upside and the second end of the tubular body positioned downside. At least one inlet port at the first end is present, where molten metal can enter into the passageway, the inlet port opens into the passageway. A plurality of outlet ports is present, where molten metal can exit the passageway (and leave the submerged nozzle into a mould), the outlet ports open into the passageway in a region adjacent to the second end. In use, the nozzle is arranged generally vertical, with the first end above the second end.

CN 108 436 071 A discloses a spin flow shroud for continuous casting comprising a swirl guide device. EP 0 030 910 A1 discloses immersion nozzles used in the electro-rotary continuous casting of liquid metals comprising blades. WO 2015/018543 A1 discloses a refractory ceramic nozzle comprising first and second grooves within the nozzle.

One of the requirements in continuous steel casting is a high flow stability from the submerged nozzle into the mould. This means that during the whole casting sequence the flow velocities of the molten metal in the mould should be stable. Additionally, any unsymmetrical flow patterns should be avoided (such as the so-called meniscus roll). The surface velocity of the steel in the mould should be as stable as possible. All of these prerequisites reduce unwanted inclusions into the steel, and thus enhance steel quality.

Accordingly, it is an object of this invention to provide a submerged nozzle and a method for continuous casting, where during pouring molten steel from a tundish into a mould, the flow stability is improved.

The object is achieved by a submerged nozzle through which molten steel can be poured from a tundish into a mould according to claim 1, and a method for continuous casting of molten steel according to claim 14 and a use of a submerged nozzle according to claim 15. The advantages and refinements mentioned in connection with the method also apply analogously to the products/physical objects and vice versa.

The core idea of the invention is based on the finding, that by having a rotatable insert in a submerged nozzle it was found that the flow stability is improved, and that during casting, the undesired meniscus roll can be strongly reduced or even completely prevented.

In a first embodiment of the invention, the object is achieved by providing a submerged nozzle through which molten steel can be poured from a tundish into a mould, said nozzle comprising:

a substantially tubular body, extending from a first end to a second end;

a passageway, extending through the tubular body along a longitudinal axis from the first end towards the second end;

at least one inlet port, opening into the passageway at said first end;

a plurality of outlet ports, opening into the passageway in a region adjacent to the second end;

and at least one rotatable insert;

and the submerged entry nozzle with the at least one rotatable insert is configured such that a molten metal entering the submerged entry nozzle at the at least one inlet port flows through the passageway and around the rotatable insert and exits the submerged entry nozzle via the plurality of outlet ports, such that a rotation of the rotatable insert is driven by the stream of molten metal.

Preferably, the at least one rotatable insert is positioned inside the passageway.

More preferably, the at least one rotatable insert is positioned inside the passageway in the region adjacent to said second end.

Preferably, the rotatable insert rotates with respect to the substantial tubular body when a fluid (such as molten steel/a metal melt) flows through the passageway.

Preferably, the rotatable insert is not connected to the turbular body, such that the rotatable insert can rotate. Preferably the rotatable insert has an outer diameter (such as a maximum outer diameter) that is smaller than an inner diameter of the passageway (especially in the region adjacent to said second end).

Preferably, the axis of rotation of the rotatable insert coincides with the longitudinal axis (A) of the tubular body.

Preferably the at least one inlet port of the submerged nozzle consists of one inlet port.

Preferably the height of the rotatable insert is larger than the (largest) height of the plurality of outlet ports.

Preferably, the submerged nozzle according to the invention is a submerged entry nozzle (SEN) or a monotube (MT) or a submerged entry shroud (SES).

Preferably, the at least one rotatable insert comprises blades. Preferably, the blades can drive the rotation of the insert, when a fluid flows through the passageway.

Preferably, the at least one rotatable insert defines an axis of rotation and comprises blades with an angle between at least one surface normal of the blades and the axis of rotation in the range of 10° to 85°, more preferably in the range of 20° to 80°. In use, such an insert will rotate around the axis of rotation, due to the force of a streaming fluid. The angle between the at least one surface normal of the blades and the axis of rotation is to be understood as the smaller angle (that is)≤90° between a first line (or direction) defined by at least one surface normal of the blades (that is the normal direction to the surface of the blade) with respect to a second line (or direction) defined by the axis of rotation.

Preferably, the at least one rotatable insert comprises 2 to 15 blades. More preferably, the at least one rotatable insert comprises 3 to 15 blades.

Preferably, the at least one rotatable insert comprises a shaft.

The at least one rotatable insert can be in the form of a propeller. Preferably, the at least one rotatable insert is in the form of a propeller with a minimum of 3 blades. The at least one rotatable insert is in the form of a propeller with a maximum of 15 blades.

Preferably, the propeller may comprise a shaft. Alternatively, the propeller may be a shaft-less propeller.

Preferably, the at least one rotatable insert is in the form of a propeller having a propeller pitch of at least 50 mm, preferably 100 mm, more preferably 200 mm.

Preferably, the at least one rotatable insert is in the form of a propeller having a propeller pitch of less than 2000 mm, preferably less than 1500 mm, more preferably less than 1000 mm.

The at least one rotatable insert may be made from a refractory material. Preferably, the at least one rotatable insert is made from a fine-grained refractory material, such as a refractory material with a maximum grain size of less than 2 mm, preferably less than 1 mm, more preferably less than 0.7 mm. This allows for smooth surfaces of the insert, especially for the blades. Preferably, the at least one rotatable insert is made from boron nitride. This leads to highly stable geometries of the insert.

Preferably the substantial tubular body comprises a wear liner section inside of the passageway. Preferably the rotatable insert is positioned inside the passageway in the region of the wear liner section. Preferably the wear liner section extends to the second end. Preferably the wear liner section forms a cage or a sleeve for the rotatable insert. The wear liner section can reduce the friction between the passageway wall and the rotatable insert.

In one embodiment the submerged nozzle is produced by the method of isostatic pressing. In this case the wear liner section is especially useful, as it allows a simpler manufacturing with a high dimensional precision.

In a second embodiment of the invention, the object is achieved by providing a method for continuous casting of molten steel, using a nozzle according to the invention. This also relates to the use of a submerged nozzle according to the invention for continuous casting of molten steel. The method allows the production of steel with a high quality, due to the stability of the metal flow resulting in reduced amounts of inclusions.

Further characteristics of the invention result from the claims, the figures and the following figure description.

All features of the invention can be combined individually or in combination. Exemplary embodiments of the invention are explained in more detail by means of illustrations:

Figure 5A:
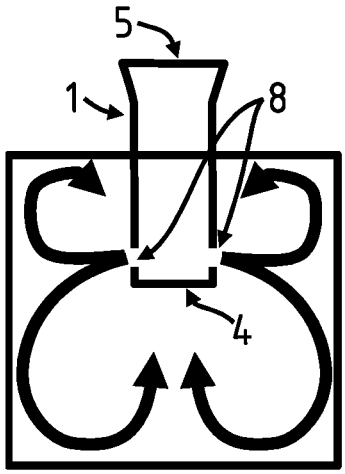

FIG. 5*a* shows schematically the flow pattern of a double roll.

Figure 5B:
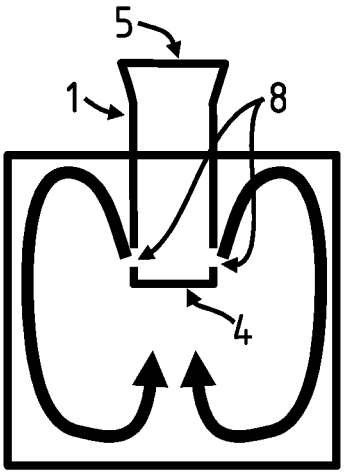

FIG. 5*b* shows schematically the flow pattern of a single roll.

Figure 5C:
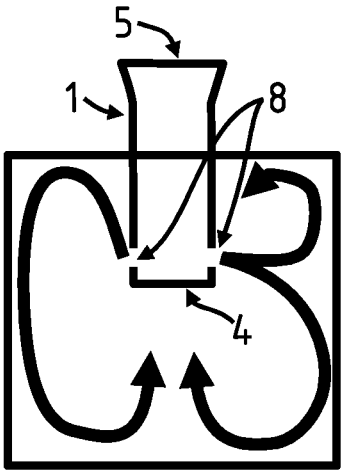

FIG. 5*c* shows schematically the flow pattern of a meniscus roll.

Figure 6:
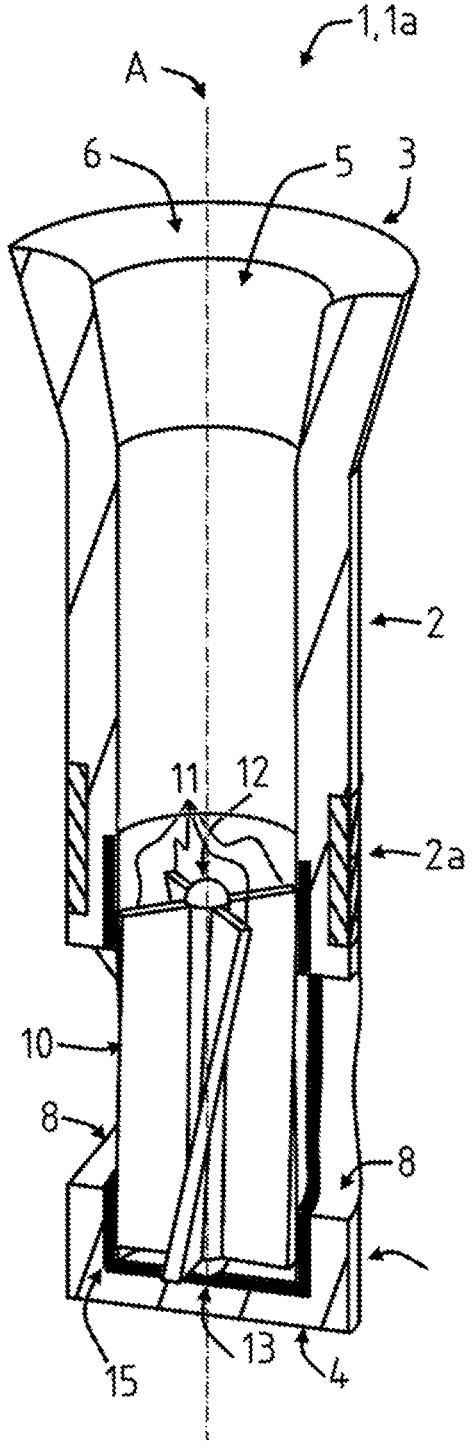

FIG. 6 shows a schematic cross-section of a schematic submerged entry nozzle (SEN) with a rotatable insert and a wear liner section.

Figure 1:
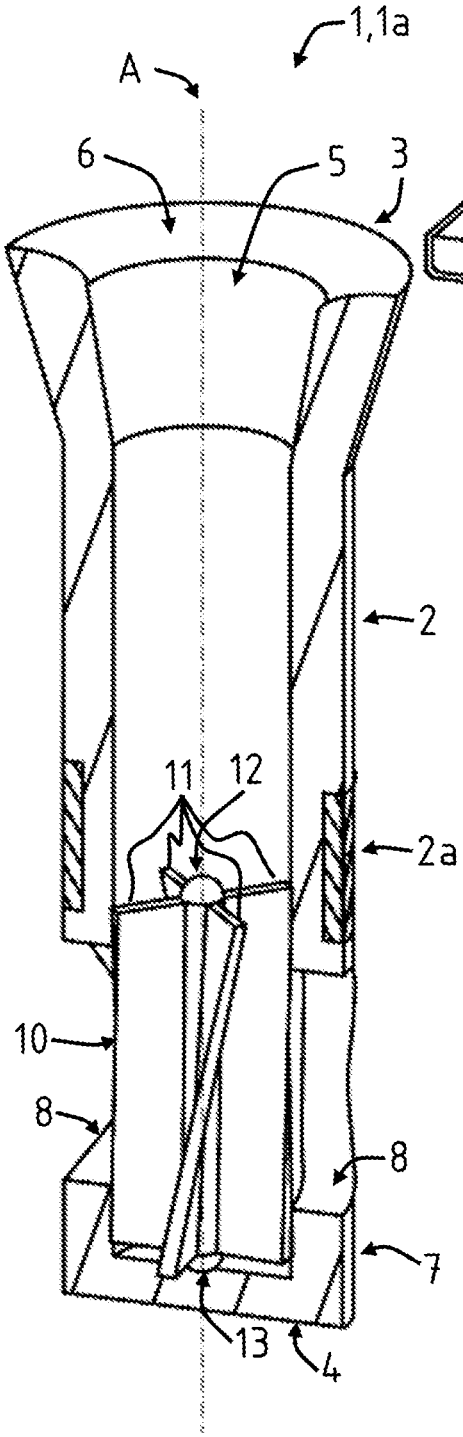
FIG. 1 shows a schematic cross-section of a schematic submerged entry nozzle (SEN) with a rotatable insert.

FIG. 1 shows a cross-section through a submerged nozzle (1), which is a submerged entry nozzle (1*a*) in its use position. The submerged nozzle (1) comprises a substantially tubular body (2) extending from a first end (3) (upper end) to a second end (4) (lower end), the substantially tubular body (2) is made of a carbon bonded refractory material. The submerged entry nozzle (1) further comprises a passageway (5), which extends through the tubular body (2), along a longitudinal axis (A) from the first end (3) to the second end (4). The passageway (5) defines a rotationally symmetrical opening, here in the form of a circular cylinder, with its axis coinciding with the longitudinal axis (A) of the submerged nozzle (2). At the first end (3) the inlet port (6) opens into the passageway (5). In a region (7) adjacent to the second end (4) two outlet ports (8) open into the passageway (5). The outlet ports (8) are circular openings in the wall of the tubular body (2). The submerged entry nozzle (1) further comprises a rotatable insert (10). The rotatable insert (10) is positioned inside the passageway (5), in a region (7) adjacent to the second end (4). The submerged entry nozzle (1) with the at least one rotatable insert (10) is configured that a molten metal entering the submerged entry nozzle (1) at the at least one inlet port (6) flows through the passageway (5) and around the rotatable insert (10) and exits the submerged entry nozzle (1) via the plurality of outlet ports (8), such that a rotation of the rotatable insert (10) is driven by the stream of molten metal. The at least one rotatable insert (10) rotates with respect to the substantial tubular body (2) when a fluid, such as a molten metal, flows through the passageway (5).

Figure 2:
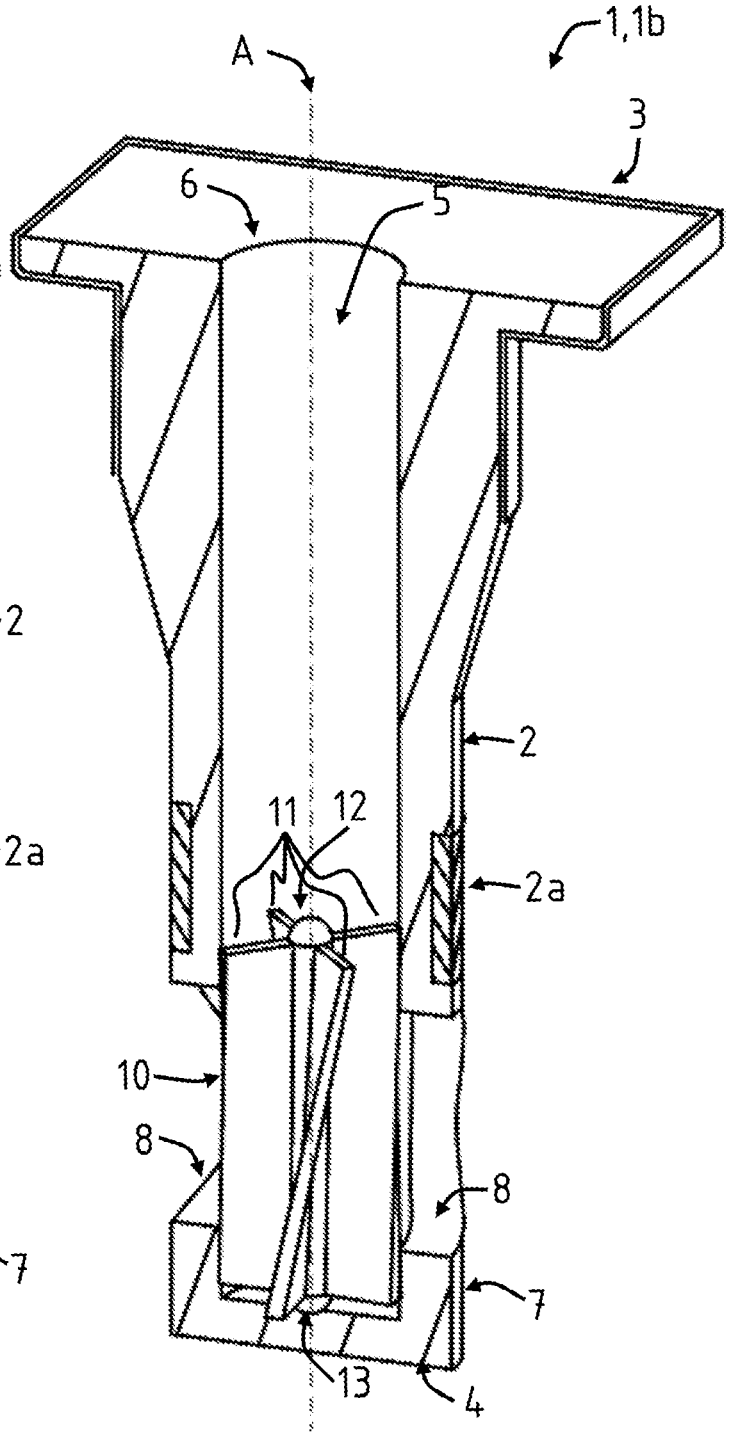
FIG. 2 shows a schematic cross-section of a schematic monotube with a rotatable insert.

FIG. 2 shows a cross-section through a submerged nozzle (1), which is a monotube (1*b*) in its use position. The difference to the submerged entry nozzle (1*a*) as shown in FIG. 1 is the geometry of the monotube (1*b*) at its first end (3). Here the monotube (1*b*) shows a connection portion for connection to a slide gate plate attachment (not shown). Apart from this different attachment geometry at its first end (3), the other parts of the monotube (1*b*) are functionally similar to the respective parts described in connection with the submerged entry nozzle (1*a*) of FIG. 1.

Figure 3:
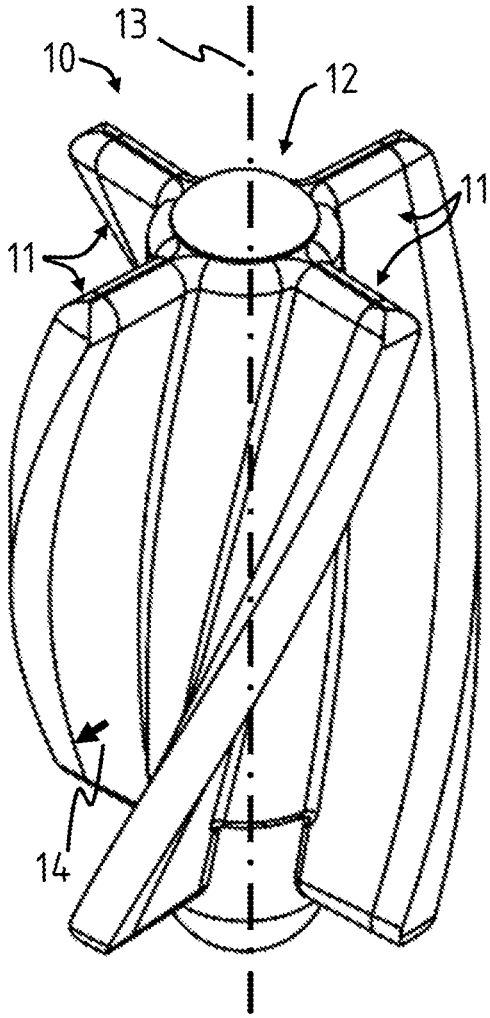
FIG. 3 shows a schematic perspective view of a first rotatable insert embodiment.

FIG. 3 shows a schematic perspective view of a first rotatable insert (10) embodiment, the at least one rotatable insert (10) defines an axis of rotation (13). Here, the at least one rotatable insert (10) is in the form of a propeller with a shaft (12) and with 4 blades (11), the blades (11) featuring a design in that the angle between the respective surface normal (14) of the blade (11) and the axis of rotation (13) is constant over the height of the insert (10). In this example, the at least one rotatable insert (10) is in the form of a propeller having a propeller pitch of 400 mm, in an alternative setup of 560 mm. The at least one rotatable insert (10) is made from a fine-grained refractory material, here the at least one rotatable insert (10) is made from boron nitride, with a maximum grain size of 0.3 mm.

Figure 4:
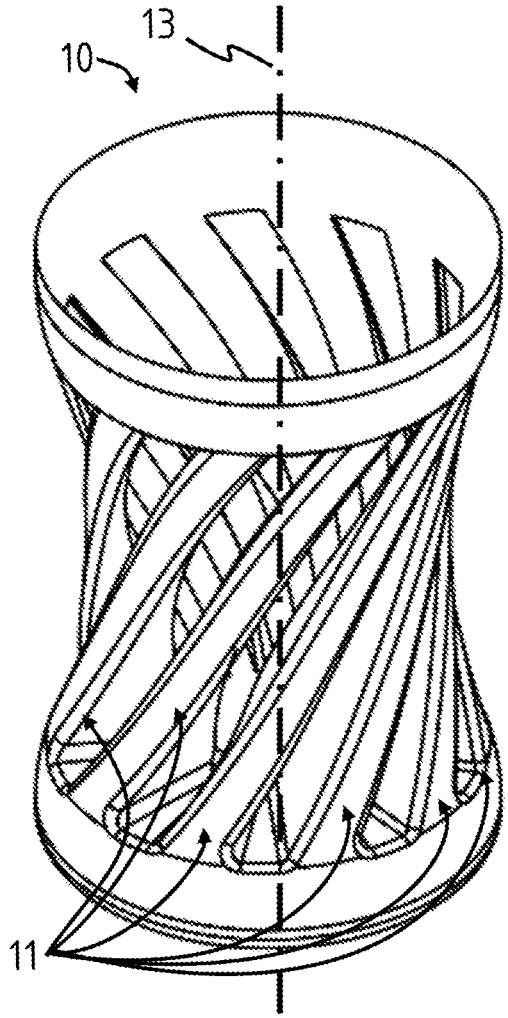
FIG. 4 shows a schematic perspective view of a second rotatable insert embodiment.

FIG. 4 shows a schematic perspective view of a second rotatable insert (10) embodiment, the at least one rotatable insert (10) defines an axis of rotation (13). Here, the at least one rotatable insert (10) is in the form of a shaft-less propeller with 10 blades (11) (this design can be called Francis Turbine). In this example, the at least one rotatable insert (10) is in the form of a propeller having a propeller pitch of 450 mm. The at least one rotatable insert (10) is made from a fine-grained refractory material, here the at least one rotatable insert (10) is made from boron nitride, with a maximum grain size of 0.3 mm. The rotatable insert (10) of FIG. 4 can be used in the embodiments according to FIGS. 1 and 2.

The mould flow pattern of a submerged nozzle according to the invention was compared to a submerged nozzle with an empty casting channel. By measuring the velocity flow in a water model, the following basic flow patterns in the mould (here the mould is of rectangular shape) could be observed:

The first flow pattern (see FIG. 5*a*) observed is the preferred flow pattern, the so-called double-roll. Here the flow of the fluid exiting the outlet ports of the submerged nozzle are in the form of two rolling flow patterns for each of the outlet ports, one rolling flow pattern directed basically above the outlet ports and the other one into the opposite direction and basically below the outlet port. This flow configuration is preferred because it minimizes non-metallic inclusions in steel.

The second flow pattern (see FIG. 5*b*) observed is acceptable, but not preferred, it is the so-called single-roll. Here the flow of the fluid exiting the outlet ports of the submerged nozzle is in the form of one (single) rolling flow pattern for each outlet port, with an initial flow going upwards (towards the meniscus; the meniscus is understood as the surface of the liquid) and then rolling down. This flow configuration is acceptable, but not preferred, because the risk for non-metallic inclusions in steel is present.

The third flow pattern (see FIG. 5*c*) observed should be avoided, it is the so-called meniscus roll. Here the flow of the fluid exiting the outlet ports of the submerged nozzle is in the form of two rolling flow patterns for one of the outlet ports, while for a second outlet port the flow pattern is in the form of one (single) rolling flow pattern, thus a mixture of single roll and double roll is present. This flow configuration should be avoided or reduced, because the risk for non-metallic inclusions in steel is increased.

The results of observed flow patterns for different geometries is shown below in Table I. All experiments were conducted over 30 minutes in a water model (scaled down 1:3) with an equivalent steel throughput for 3.16 tons/minute.

In the first experiment the first rotatable insert as shown in FIG. 3 was used inside the submerged nozzle (according to FIG. 1). During the experimental sequence, 99.8% of the time the observed flow pattern showed a double roll situation (according to FIG. 5*a*). No single roll (FIG. 5*b*) and a very low rate (0.2%) of meniscus roll (FIG. 5*c*) situation was observed at all.

In the second experiment the second rotatable insert as shown in FIG. 4 was used inside the submerged nozzle (according to FIG. 1). During the experimental sequence, 100% of the time the observed flow pattern showed a double roll situation (according to FIG. 5*a*). No single roll (FIG. 5*b*) or meniscus roll (FIG. 5*c*) situation was observed at all.

In the third experiment no insert was used inside the submerged nozzle (comparative example). During the experimental sequence, 83.8% of the time the observed flow pattern showed a double roll situation (according to FIG. 5*a*). Single roll situation (FIG. 5*b*) was present at 0.5% of the time, and meniscus roll situation (FIG. 5*c*) was observed at 15.8% of the time.

In conclusion the experiments show the reduction of the (unwanted) meniscus roll situation (FIG. 5*c*) by using a rotatable insert in a submerged nozzle compared to an empty passageway. Thereby the rotatable insert in a submerged nozzle improves the flow stability, as with the insert a highly stable double roll flow characteristics is achieved.

FIG. 6 shows a cross-section through a submerged nozzle (1) similar to that of FIG. 1, with the difference, that the substantially tubular body (2) comprises a wear liner section (15) inside of the passageway (5), and wherein the rotatable insert (10) is positioned inside the passageway (5) in the region (7) of the wear liner section (15). The wear liner section (15) extends to the second end (4) of the passageway (5). The wear liner section (15) was separately formed before the production of the whole submerged nozzle (1), in this example it was formed as a cage/sleeve. It showed that the production process in the case the submerged nozzle (1) is produced by isostatic pressing is simplified and that the cage/sleeve forming the wear liner section (15) could achieve an enhanced dimensional precision and thus showed an improved and more constant rotation of the rotatable insert (10).

TABLE I

Comparison of the flow pattern (double roll, single roll or meniscus roll in percentage of the overall time) observed using the first rotatable insert (FIG. 3), the second rotatable insert/Francis turbine insert (FIG. 4) or an empty casting channel:

| | First rotatable insert | Second rotatable insert | No rotatable insert (comp. example.) |
|---|---|---|---|
| Double roll | 99.8% | 100% | 83.8% |
| Single row | 0% | 0% | 0.5% |
| Meniscus roll | 0.2% | 0% | 15.8% |

LIST OF REFERENCE NUMERALS AND FACTORS

1 Submerged nozzle
1*a* Submerged entry nozzle (SEN)
1*b* Monotube
1*c* Submerged entry shroud (SES)
2 Tubular body
2*a* Slag band
3 First end
4 Second end
5 Passageway
6 Inlet port
7 Region adjacent to second end (4)
8 Outlet port
10 Rotatable insert
11 Blades
12 Shaft
13 Axis of rotation
14 Surface normal of blades (11)
15 Wear liner section/cage for rotatable insert
A Longitudinal axis of tubular body (2)

The invention claimed is:

1. Submerged nozzle (1) through which molten steel can be poured from a tundish into a mould, said nozzle comprising:

1.1 a substantially tubular body (2), extending from a first end (3) to a second end (4);

1.2 a passageway (5), extending through the tubular body (2) along a longitudinal axis (A) from the first end (3) towards the second end (4);

1.3 at least one inlet port (6), opening into the passageway (5) at said the first end (3);

1.4 a plurality of outlet ports (8), opening into the passageway (5) in a region (7) adjacent to the second end (4); and 1.5 at least one rotatable insert (10);

1.6 wherein the submerged nozzle (1) with the at least one rotatable insert (10) is configured such that a molten metal entering the submerged nozzle (1) at the at least one inlet port (6) flows through the passageway (5) and around the rotatable insert (10) and exits the submerged entry nozzle (1) via the plurality of outlet ports (8), such that a rotation of the rotatable insert (10) is driven by the molten metal.

2. Submerged nozzle (1) according to claim 1, wherein the at least one rotatable insert (10) is positioned inside the passageway (5).

3. Submerged nozzle (1) according to claim 2, wherein the at least one rotatable insert (10) is positioned inside the passageway in a region (7) adjacent to the second end.

4. Submerged nozzle (1) according to claim 1, wherein the at least one rotatable insert (10) rotates with respect to the substantial tubular body (2) when a fluid flows through the passageway (5).

5. Submerged nozzle (1) according to claim 1, wherein the submerged nozzle (1) is a submerged entry nozzle (SEN) (1*a*) or a monotube (1*b*) or a submerged entry shroud (SES) (1*c*).

6. Submerged nozzle (1) according to claim 1, wherein the rotatable insert (10) defines an axis of rotation (13) and comprises blades (11) with an angle between at least one surface normal (14) of the blades (11) and the axis of rotation (13) in the range of 10° to 85°.

7. Submerged nozzle (1) according to claim 6, wherein the angle between the at least one surface normal (14) of the blades (11) and the axis of rotation (13) is in the range of 20° to 80°.

8. Submerged nozzle (1) according to claim 1, wherein the rotatable insert (10) is in the form of a propeller with a minimum of 2 blades.

9. Submerged nozzle (1) according to claim 1, wherein the rotatable insert (10) is in the form of a propeller with a maximum of 15 blades.

10. Submerged nozzle (1) according to claim 1, wherein the rotatable insert (10) is in the form of a propeller having a propeller pitch of at least 50 mm.

11. Submerged nozzle (1) according to claim 10, wherein the propeller pitch is at least 200 mm.

12. Submerged nozzle (1) according to claim 1, wherein the rotatable insert (10) is in the form of a propeller having a propeller pitch of less than 2000 mm.

13. Submerged nozzle (1) according to claim 1, wherein the rotatable insert (10) is made from a refractory material.

14. Submerged nozzle (1) according to claim 13, where in refractory material is boron nitride.

15. Submerged nozzle (1) according to claim 1, wherein the rotatable insert (10) is made from a refractory material with a maximum grain size of less than 2 mm.

16. Submerged nozzle (1) according to claim 15, wherein the the maximum grain size is less than 0.7 mm.

17. Submerged nozzle (1) according to claim 1, wherein the substantially tubular body (2) comprises a wear liner section (15) inside of the passageway (5), and wherein the rotatable insert (10) is positioned inside the passageway (5) in the region (7) of the wear liner section (15).

18. Submerged nozzle (1) according to claim 1, wherein the submerged nozzle (1) is produced by isostatic pressing.

19. A method comprising:

obtaining a submerged nozzle through which molten steel can be poured from a tundish to a mould, the submerged nozzle comprising:

a substantially tubular body extending from a first end to a second end;

a passageway extending through the tubular body along a longitudinal axis from the first end towards the second end;

at least one inlet port opening into the passageway in a region adjacent to the second end;

a plurality of outlet ports opening into the passageway in a region adjacent to the second end; and at least one rotatable insert, wherein the submerged nozzle with the at least one rotatable insert is configured such that a molten metal entering the submerged nozzle at the at least one inlet port flows through the passageway and around the rotatable insert and exits the submerged nozzle via the plurality of outlet ports, such that a rotation of the rotatable insert is driven by the molten metal; and continuously casting the molten metal using the submerged nozzle.

20. A method comprising:

positioning a submerged nozzle in a tundish; and pouring molten steel through the submerged nozzle into a mould, the submerged nozzle comprising:

a substantially tubular body extending from a first end to a second end;

a passageway extending through the tubular body along a longitudinal axis from the first end towards the second end;

at least one inlet port opening into the passageway in a region adjacent to the second end;

a plurality of outlet ports opening into the passageway in a region adjacent to the second end; and at least one rotatable insert, wherein the submerged nozzle with the at least one rotatable insert is configured such that the molten metal entering the submerged nozzle at the at least one inlet port flows through the passageway and around the rotatable insert and exits the submerged nozzle via the plurality of outlet ports, such that a rotation of the rotatable insert is driven by the molten metal.

* * * * *